US006367630B1

(12) United States Patent
Elskamp

(10) Patent No.: US 6,367,630 B1
(45) Date of Patent: Apr. 9, 2002

(54) HIGH STACKING-STRENGTH CONTAINER

(75) Inventor: Eric R. Elskamp, Watertown, WI (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 09/677,038

(22) Filed: Sep. 29, 2000

Related U.S. Application Data

(60) Provisional application No. 60/185,803, filed on Feb. 29, 2000.

(51) Int. Cl.[7] ..... B65D 21/00

(52) U.S. Cl. ..... 206/508; 220/1.5; 220/644

(58) Field of Search ..... 206/508, 509, 206/511; 220/1.5, 643, 644

(56) References Cited

U.S. PATENT DOCUMENTS 3,419,182 A * 12/1968 Gildart ..... 220/643
3,419,184 A * 12/1968 Asenbauer ..... 206/508
3,759,416 A * 9/1973 Constantine ..... 206/508 X
3,997,074 A * 12/1976 Shead ..... 220/644 X

FOREIGN PATENT DOCUMENTS

| | | |
|---|---|---|
| FR | 2578224 | 9/1986 |
| NZ | 199169 | 11/1985 |
| NZ | 220430 | 9/1989 |

* cited by examiner

*Primary Examiner*—Steven Pollard
(74) *Attorney, Agent, or Firm*—Quarles & Brady LLP

(57) ABSTRACT

Disclosed herein is a high strength container particularly suited for containing heavy materials and being stacked when fill and nested when emptied. The container includes a receptacle having tapered upright walls that are capped by a lid. The receptacle has an abruptly enlarged upper perimeter joined to a lower perimeter by a horizontal ledge, which resists bulging of the walls under heavy loading. The lid has grooves at stacking support surfaces in which reinforcing members are disposed. The reinforcing members can include winged saddles to disposed in indentations in the lid that are designed to better distribute loads through the receptacle.

17 Claims, 6 Drawing Sheets

HIGH STACKING-STRENGTH CONTAINER

CROSS-REFERENCE TO RELATED APPLICATION

This application claims benefit to U.S. provisional application Ser. No. 60/185,803, filed Feb. 29, 2000.

STATEMENT CONCERNING FEDERALLY SPONSORED RESEARCH OR DEVELOPMENT

Not applicable.

BACKGROUND OF THE INVENTION

1. Field of the Invention

This invention relates to molded plastic containers which are made to be stacked one on top of another.

2. Discussion of Prior Art

Bulk boxes or containers for shipment and storage may, when filled, weigh many hundreds, or even a few thousand, pounds. To conserve space in transit and storage, it is desirable that these containers be stacked one on top of another. Therefore, the load supported on the bottom container may be many thousands of pounds.

These containers are often molded of plastic materials and are made to be reusable. They must, therefore, be capable of supporting the weight without permanent deformation. It is also desirable that such boxes be nestable, so that when they are emptied they may be nested inside one another and returned for refilling.

SUMMARY OF THE INVENTION

The invention provides a bulk container, including a lid, which is capable of bearing high stacking loads when one container is stacked on top of the lid of the next lower container.

Specifically, the present invention provides a plastic container for carrying heavy loads having a receptacle and a lid. The receptacle is formed of upright walls joined together at a lower edge by a bottom so as to define an open cavity closable by the lid. The lid has a support surface on which the bottom of a second container stacked thereon is supported. An elongated reinforcing member is secured to the lid beneath the bottom of the second container so as to support the second container. The reinforcing member substantially spans the upright walls on opposite sides of the receptacle and is supported above the upright walls by a saddle which cradles the reinforcing member and distributes loading from the reinforcing member to the lid.

In a preferred embodiment, the receptacle bottom has three flat feet that project downwardly and the support surface of the lid defines three recessed surfaces sized to receive the feet of a second receptacle stacked thereon. The feet are spaced apart in parallel to define a pair of channels sized to receive forks from a forklift. Three reinforcing members are disposed in grooves extending substantially along the middle of the recessed surfaces so as to underlie said feet of receptacle stacked thereon. The saddles are recessed in portions of the lid. Each saddle has a generally U-shaped center portion, and wings extending laterally outwardly from upper ends of the center portion. Lower surfaces of the center portion and wings bear against surfaces of the lid.

One feature of the container that contributes to its high stacking-strength is that it includes the rigid reinforcing members disposed in the lid. Forces are transferred from the lid at the ends of the reinforcing members to the container walls below. The members extend long enough all the way across the width of the container so as to overlap the lower container's side walls at the ends of the members. Forces are transferred from the ends of the members to the lid by the saddles which extends below each member up along the sides of the member and out laterally from the sides of the member.

Another feature of the invention which contributes to the high stacking strength of the container is that the upper portion of the container is abruptly enlarged in relation to the lower portion. The abrupt enlargement creates a horizontal convolution which encircles the container for 360° and contributes to the ability of the sides of the container to resist bulging. It does this while permitting the use of generally vertically running convolutions in the side walls of the container, both in the lower portion and in the upper portion. However, the vertical convolutions in the upper portion are preferably offset from the convolutions in the lower portion to provide horizontal surfaces or cross sections that resist bulging and buckling of the side walls of the container.

Still another strength enhancing feature is that the corners of the container, where the top portion transitions to the smaller portion, are more gradually transitioned to the smaller portion than the sides of the container. This may be done with a sloping surface, or a generally conical section of a surface to join the enlarged top portion of the container to the relatively smaller bottom portion of the container at the corners of the container. Thus, the ability of the corners to withstand vertical loading is significantly increased to resist collapse of the corners.

These and other advantages of the invention will be apparent from the detailed description and drawings.

DETAILED DESCRIPTION OF THE PREFERRED EMBODIMENT

Figure 1:
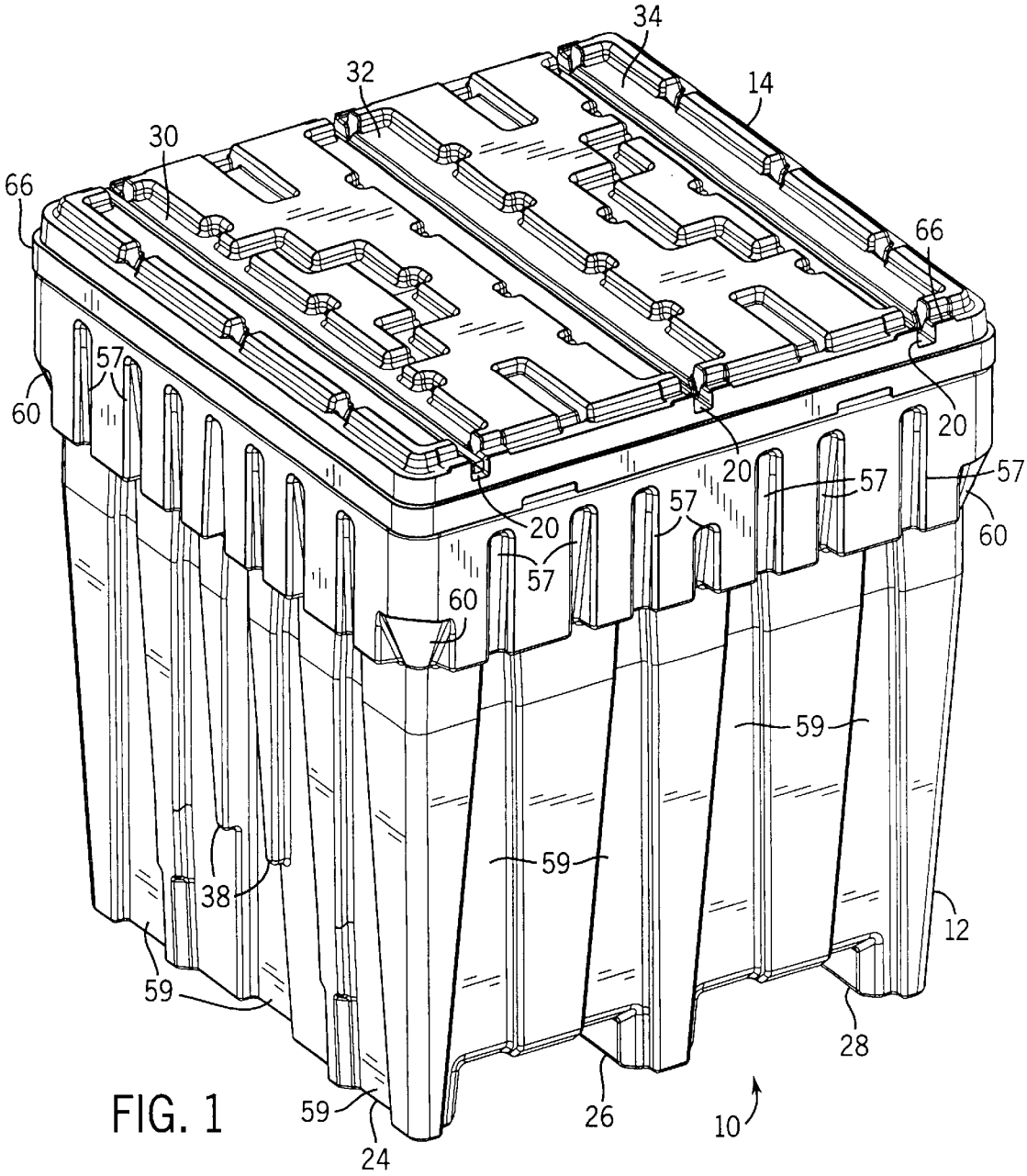
FIG. 1 is a perspective view of a container and lid of the invention, the lid being illustrated without reinforcing members or saddles.
Figure 8:
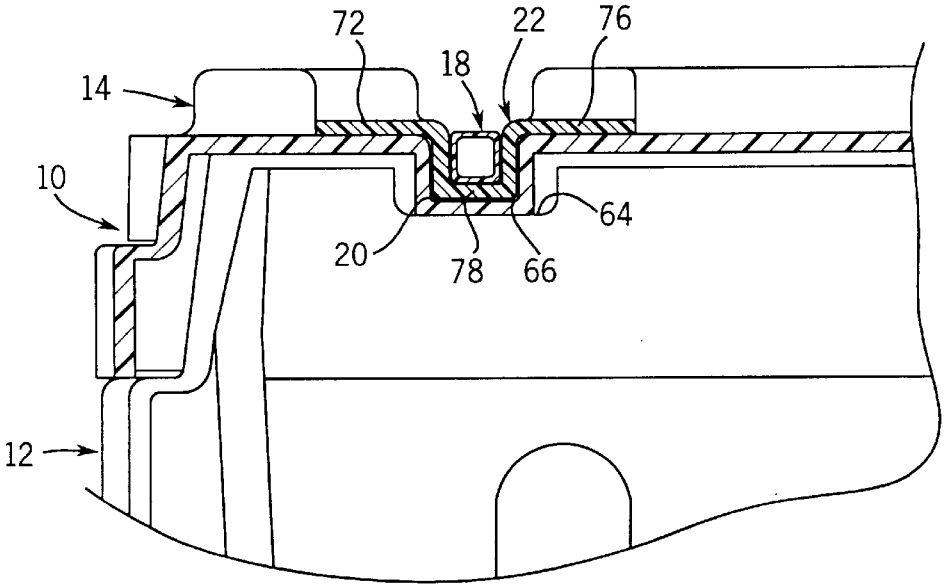
FIG. 8 is a sectional view from the plane of the line 8—8 of FIG. 7, shown with a reinforcing member and saddle installed (one of three members and one of six saddles)

Referring to FIG. 1, a container 10 of the invention includes a receptacle 12 and a lid 14. The container 10 also preferably is provided with three reinforcing members 18 (FIGS. 8 and 9), one provided in each of the grooves 20 provided in the lid 14, and one saddle 22 received in the lid at each end of each of the members 18 with a total of six saddles per lid and three members per lid. The receptacle 12 and lid 14 are molded plastic, e.g. polypropylene, which may be made by a roto molding process, the members 18 are square steel tubes, and the saddles 22 are solid steel made from strap or bar stock. The dimensions of the receptacle 10, are, for example, 45.25"×44.5" at the top, and it is about 49" tall.

Still referring to FIG. 1, the receptacle 12 has three feet 24, 26, 28 which run the width of the receptacle 12 at the bottom and define between them fork slots for the container 10 to be picked up by a forklift. The bottoms of the feet 24, 26, 28 are flat, as are the recessed surfaces 30, 32, 34 in the lid 14. The surfaces 30, 32, 34 are recessed and large enough to receive the respective feet 24, 26, 28. The grooves 20 are provided generally down the middle of the surfaces 30, 32, 34 and are approximately the height of the reinforcing members 18, so that the top of the reinforcing members are flush with the surfaces 30, 32, 34. As such, most of the weight exerted through the feet 24, 26, 28 is born by the reinforcing members 18.

Referring also to FIGS. 2–5, the receptacle 12 tapers top to bottom, which is why the feet 24, 26, 28 can fit within the recessed surfaces 30, 32, 34. This also permits one receptacle 12 to be nested inside of another with nesting stops provided by ledges 54. The ledge 54 of the upper container has lower surfaces which abut the upper surfaces of the ledge 54 of the lower container when two receptacles 12 are nested together. Providing the nesting stops makes denesting containers easier.

One feature of the receptacle 12 which increases its ability to contain heavy loads of flowable materials, such as small items, is that the walls of the receptacle 12 are resistant to bulging. This includes the end walls 40, 42 and the side walls 44, 46. What makes the walls 40, 42, 44, 46 resistant to bulging is that the upper portion 50 of the receptacle 12 is abruptly larger than the lower portion 52 at the ledge 54 which goes all the way around the receptacle 12. The ledge 54 essentially provides a horizontal convolution which increases the resistance to bending in the horizontal direction of each of the walls 40,42,44, and 46. Vertical convolutions 57,59 are provided in the walls of the receptacle 12 as illustrated. The vertical convolutions 57 provided in the upper portion 50 are offset from the vertical convolutions 59 provided in the lower portion 52 since if they were not offset they would interrupt the ledge 54 to such an extent so as to create a weak point at which the wall could bend or bulge outwardly if loaded with a heavy, flowable load.

Figure 2:
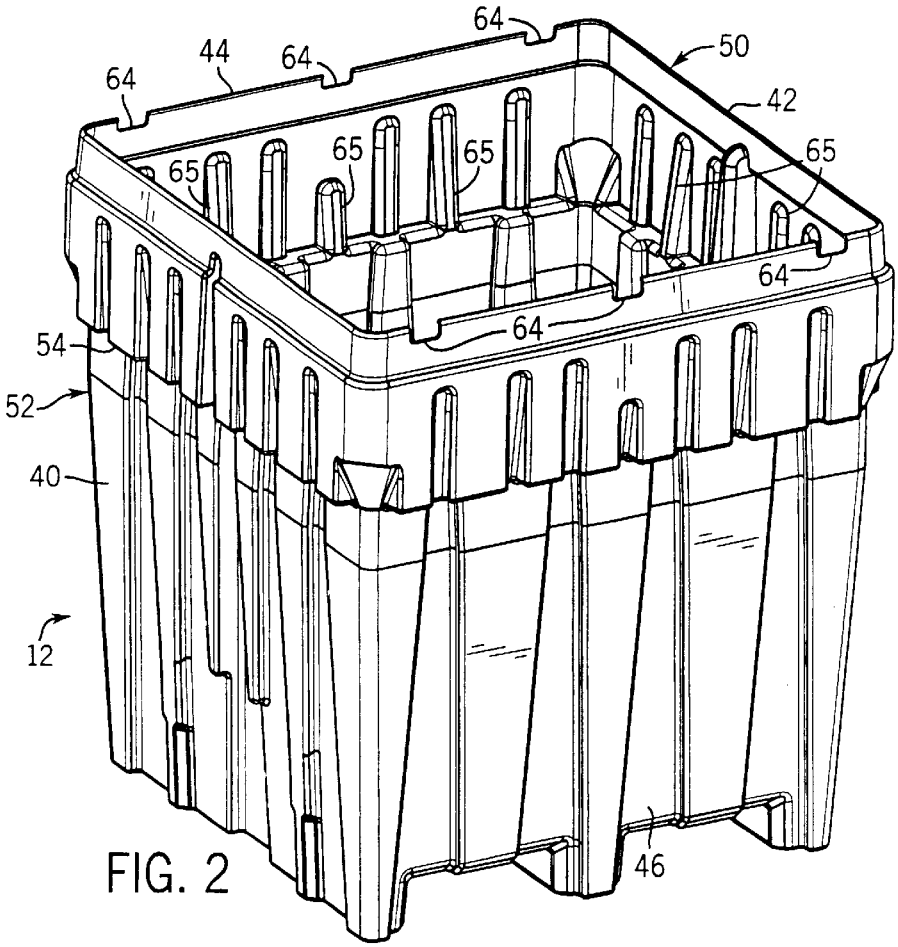
FIG. 2 is a perspective view of the container with the lid removed.
Figure 3:
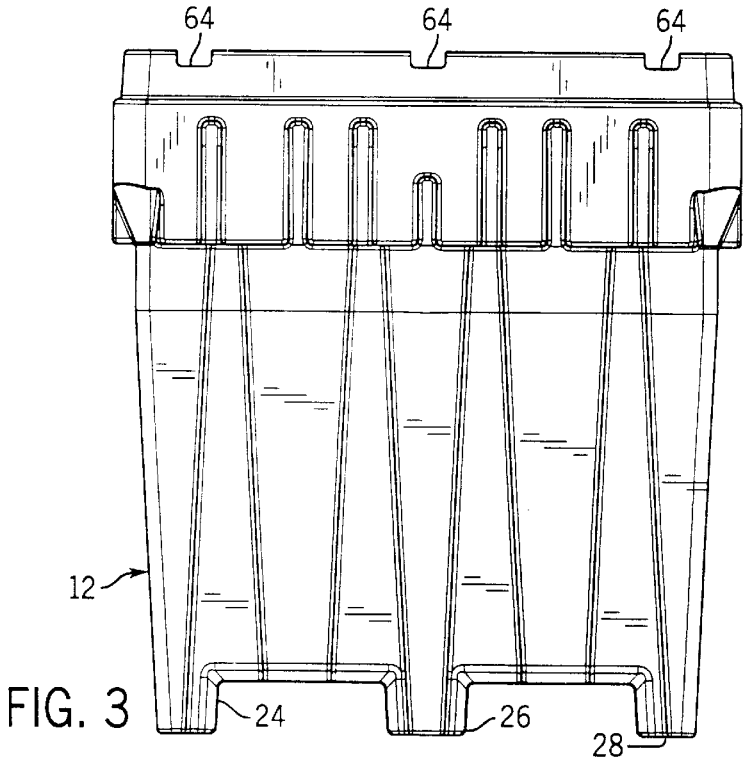
FIG. 3 is a side elevation view of the container.
Figure 4:
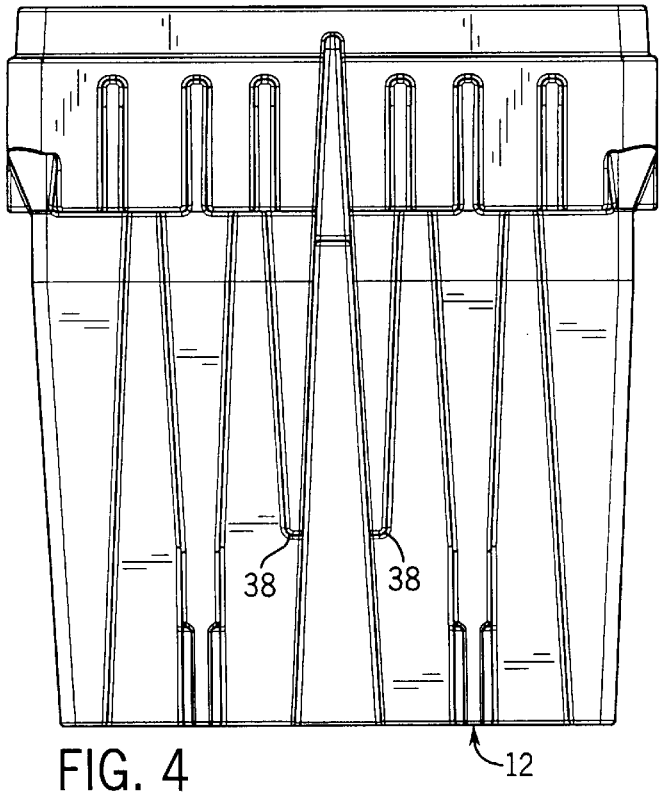
FIG. 4 is an end elevation view of the container.
Figure 5:
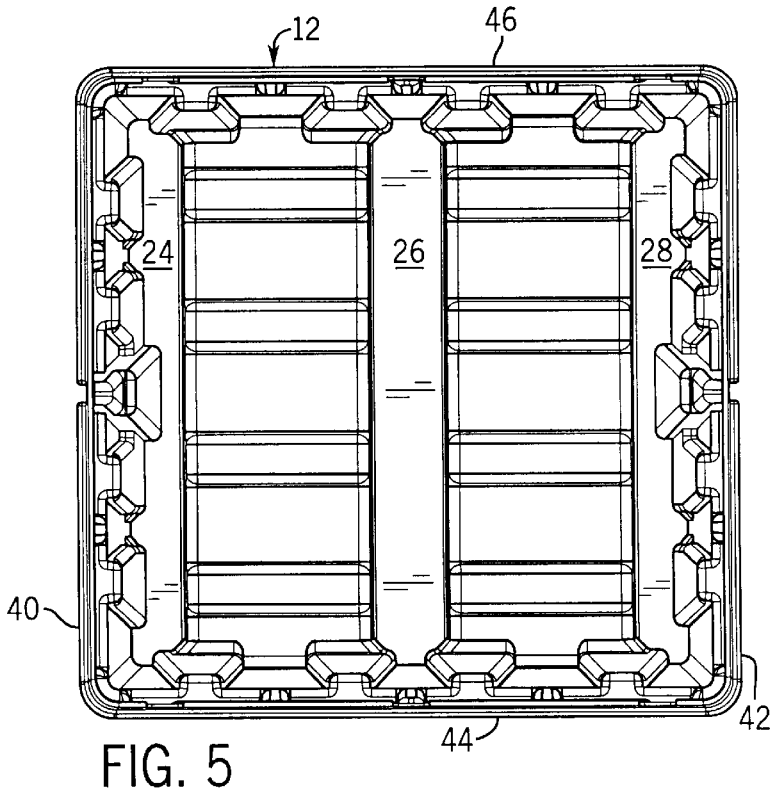
FIG. 5 is a top elevation view of the container.
Figure 6:
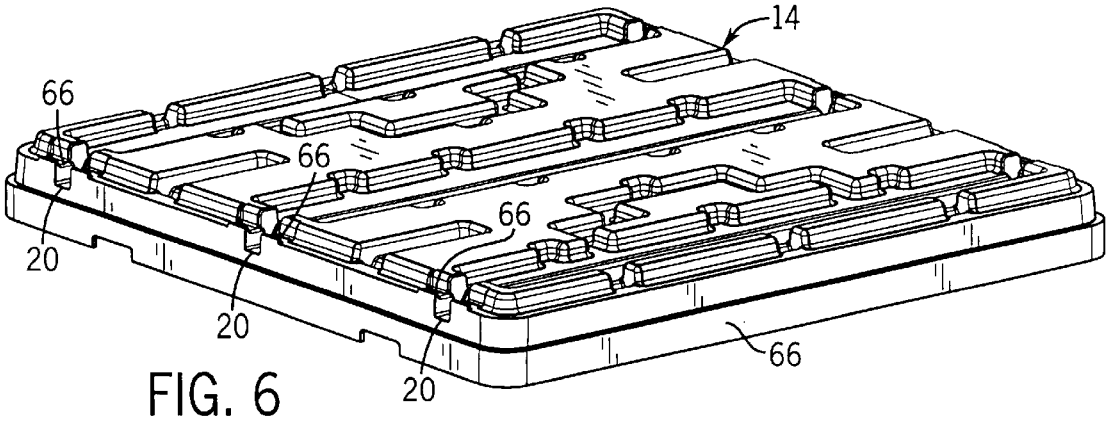
FIG. 6 is a perspective view of the lid for the container, illustrated without reinforcing members or saddles.
Figure 7:
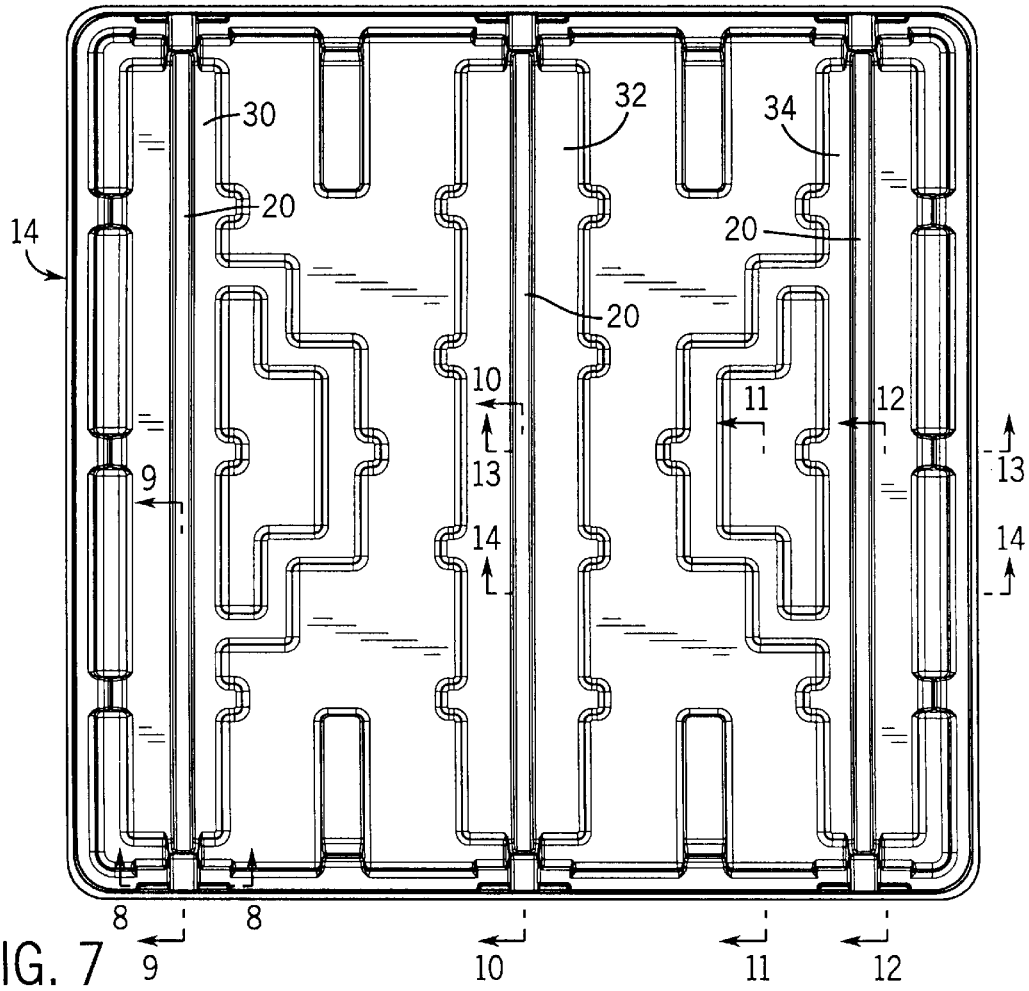
FIG. 7 is a top plan view of the lid shown without reinforcing members or saddles.

The upper portion 50 of the receptacle 12 has inwardly projecting ribs 65 that extend down to intersect the ledge 54.(see FIG. 2). At the end walls 44 and 46 there are two taller ribs 65 spaced apart on opposite sides of a shorter rib 65 at the center of the walls. The other end walls 40 and 42 have two taller ribs 65 spaced apart along the width of the sides. These ribs 65 are structural vertical members of the upper portion 50 that are tied to the ledge 54. This helps to transfer loads from the upper portion 50 through the ledge 54 to the walls of the lower portion 52.

The size of the upper portion 50 changes abruptly from the size of the lower portion 52 at the ledge 54, except at the corners 60 of the receptacle 12. As illustrated, at each corner 60 there is a gradual transition provided from the lower portion 52 to the upper portion 50. This transition is provided in the shape of a section of a cone, although any suitable shape could be provided which is capable of exerting a vertical load through the corner of the receptacle 12 without undue bending of the material at the corner. If an abrupt transition is provided at the corners of the receptacle 12, the vertical load exerted on the corner when containers are stacked can cause the corners to bend or buckle. Thus, the gradual transition of the corners 60 provides substantial vertical loads to be transmitted from the upper portion 50 to the lower portion 52 through the corners.

The upper edge of each of the side walls 44, 46 is notched in three places at 64 so as to receive the grooves 20 in the notches 64. The lid 14 has a peripheral lip 66 which runs all of the way around the lid 14 and receives within it the upper edge of the receptacle 12 for 360°, which also helps resist bulging of the side walls and end walls of the container 12, especially at the top.

Figure 9:
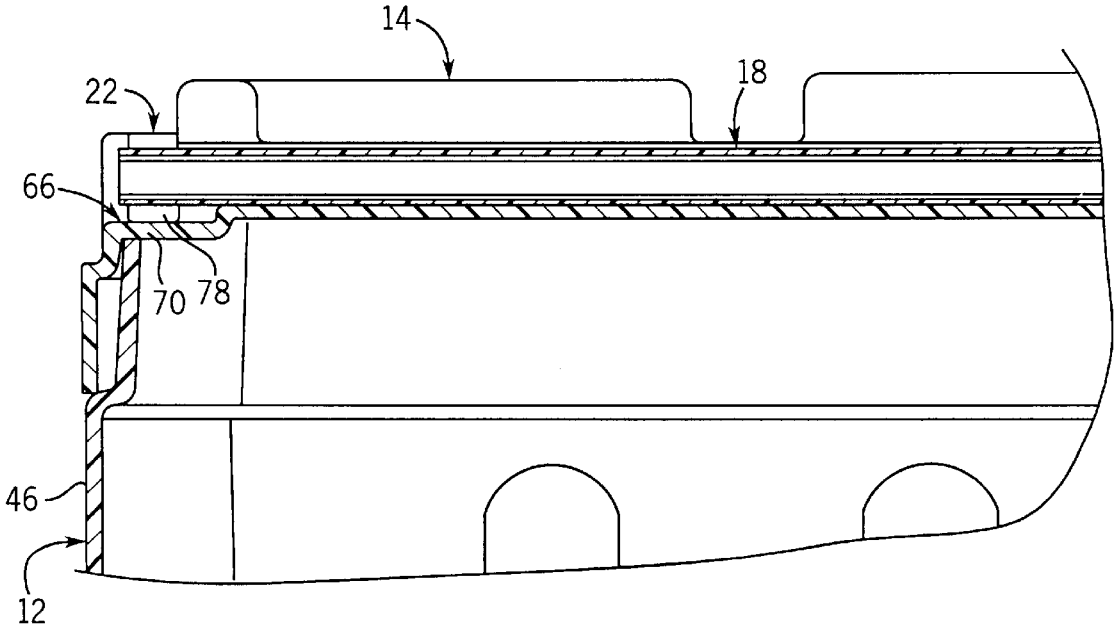
FIG. 9 is a sectional view from the plane of the line 9—9 of FIG. 7 showing the container, lid, reinforcing member and saddle assembly.
Figure 10:
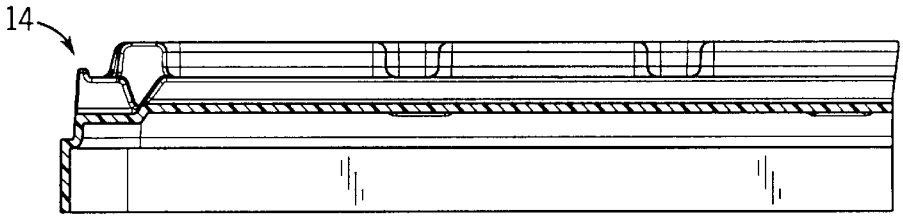
FIG. 10 is a sectional view from the plane of the line 10—10 of FIG. 7 showing the lid alone.
Figure 11:
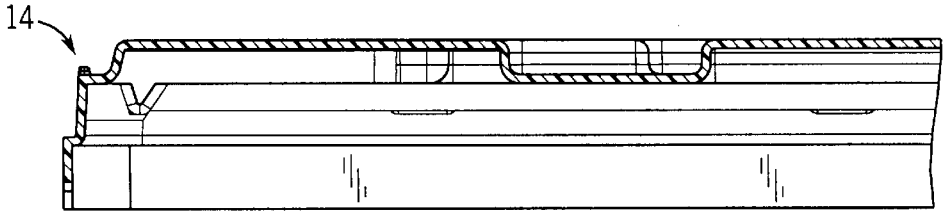
FIG. 11 is a sectional view from the plane of the line 11—11 of FIG. 7 showing the lid alone.
Figure 12:
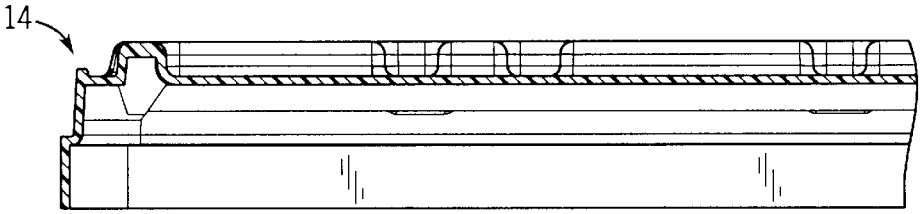
FIG. 12 is a sectional view from the plane of the line 12—12 of FIG. 7 showing the lid alone.
Figure 13:
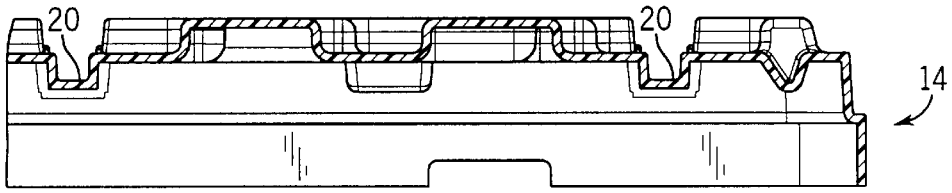
FIG. 13 is a sectional view from the plane of the line 13—13 of FIG. 7 showing the lid alone.
Figure 14:
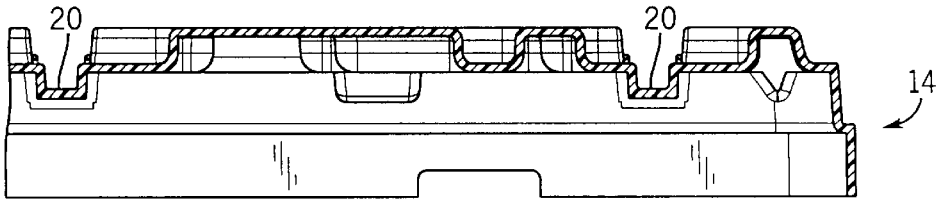
FIG. 14 is a sectional view from the plane of the line 14—14 of FIG. 7 showing the lid alone.

Referring particularly to FIGS. 1 and 7–14, at the end of each groove 20, an indentation 66 is formed which indentation is in the shape of the saddle 22. The saddle 22 is trapped between the indentation 66 in the lid 14 and the reinforcing member 18. The reinforcing member is secured to the lid 14 by any suitable means, such as one or more rivets, bolts, or other suitable means. As shown in FIG. 9, between the indentations 66, the bottom of the groove 20 raises up so as to touch or be in close proximity to the bottom of the reinforcing members 18. The top of the members 18, as stated above, is flush with the surfaces 30, 32, 34 on which rest the feet 24, 26, 28 when two containers 10 are stacked on top of one another. As shown in FIG. 9, the members 18 are long enough to extend out to the upper edge of the side walls 44,46, so that the load supported by the member 18 is transferred directly from the end of the member 18, down through the saddle 22, through the lower wall 70 of the depression 66 and to the top edge of the receptacle 12, both in the center of the notch 64 and to the sides of the notch 64, since the saddle 22 has wings 72, 76 which extend to the sides of each notch 64. If desired, the saddle 22 may be formed so that weight from the end of the member 18 is first transferred to the wings 72 and 76 directly down through the side walls of the receptacle 12 to the sides of the notch 64, before the bottom leg 78 of the saddle contacts or transfers any significant weight to the receptacle 12 in the middle of the notch 64. This helps assure more equal loading along the length of the saddle 22.

A preferred embodiment of the invention has been described in considerable detail. Many modifications and variations to the preferred embodiment will be apparent to those skilled in the art, which will be within the spirit and scope of the invention. Therefore, the invention should not be limited to the described embodiment. To ascertain the full scope of the invention, the following claims should be referenced.

What is claimed is:

1. In a plastic container for carrying heavy loads having a receptacle and a lid, the receptacle being formed of upright walls joined together at a lower edge by a bottom so as to define an open cavity closable by the lid, the improvement wherein the lid has a support surface on which the bottom of a second container stacked thereon is supported, and wherein elongated reinforcing members are secured to said lid beneath said bottom of said second container so as to support said second container, said reinforcing member substantially spanning the upright walls of said receptacle on opposite sides of said receptacle and being supported above each of said upright walls by a saddle which cradles said reinforcing member and distributes loading from said reinforcing member to said lid.

2. The improvement of claim 1, wherein said reinforcing member is recessed in said lid.

3. The improvement of claim 1, wherein each of said saddles has wings extending outwardly from sides of said reinforcing member.

4. The improvement of claim 3, wherein said wings are above a lower surface of said reinforcing member.

5. The improvement of claim 1, wherein said saddles are recessed in portions of said lid.

6. The improvement of claim 1, wherein each said saddle has a generally U-shaped center portion, and wings extending laterally outwardly from upper ends of said center portion, and wherein lower surfaces of said center portion and wings bear against surfaces of said lid.

7. The improvement of claim 6, wherein upper edges of said upstanding walls have recesses which underlie said center portion of each said saddle and upper edge portions which underlie said wings of each said saddle.

8. The improvement of claim 1, wherein said bottom has flat feet which project downwardly and wherein said support surface of said lid defines recessed surfaces that are sized to receive the feet of a second receptacle stacked thereon, and wherein said reinforcing members underlie said feet of said second receptacle.

9. The container of claim 8, wherein said lid has three recessed surfaces and three reinforcing members disposed in grooves extending substantially along the middle of said recessed surfaces.

10. The container of claim 9, wherein said receptacle bottom includes three parallel feet defining a pair of channels sized to receive forks from a forklift.

11. The container of claim 1, wherein said upright walls have an upper perimeter that is larger than a lower perimeter, the upper and lower perimeters joined at a ledge encircling said container so as to resist bulging of said walls.

12. The container of claim 11, wherein said walls further include vertical convolutions, wherein the vertical convolutions of the upper perimeter are offset from the convolutions of the lower perimeter.

13. The container of claim 12, wherein said ledge is substantially perpendicular to said walls along straight portions of said walls.

14. The container of claim 13, wherein said walls form corners therebetween and wherein at said corners said ledge extends at an acute angle from said walls.

15. The container of claim 14, wherein at said corners said ledge is an arcuate surface.

16. The container of claim 11, wherein said walls are canted outward from bottom to top so that multiple receptacles can be nested one within another.

17. The container of claim 16, wherein said walls include nesting stops.

* * * * *

UNITED STATES PATENT AND TRADEMARK OFFICE

CERTIFICATE OF CORRECTION

PATENT NO. : 6,367,630 B1
DATED : April 9, 2002
INVENTOR(S) : Eric R. Elskamp

It is certified that error appears in the above-identified patent and that said Letters Patent is hereby corrected as shown below:

Title page,
Item [57], ABSTRACT,
Line 3, "fill" should be -- full --.

Column 4,
Line 60, "wherein elongated" should be -- wherein an elongated --.
Line 60, "members are" should be -- member is --.

Signed and Sealed this

Twelfth Day of November, 2002

*Attest:*

*Attesting Officer*

JAMES E. ROGAN
*Director of the United States Patent and Trademark Office*